US008923733B2

(12) United States Patent
Kuramoto et al.

(10) Patent No.: US 8,923,733 B2
(45) Date of Patent: Dec. 30, 2014

(54) DEVELOPER SUPPLYING DEVICE AND IMAGE FORMING APPARATUS

(71) Applicant: Fuji Xerox Co., Ltd., Tokyo (JP)

(72) Inventors: Shinichi Kuramoto, Kanagawa (JP); Satoru Yugeta, Kanagawa (JP); Hirokazu Murase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/012,623

(22) Filed: Aug. 28, 2013

(65) Prior Publication Data

US 2014/0147173 A1 May 29, 2014

(30) Foreign Application Priority Data

Nov. 29, 2012 (JP) ..... 2012-261695

(51) Int. Cl.
*G03G 15/08* (2006.01)

(52) U.S. Cl.
CPC ..... *G03G 15/0893* (2013.01); *G03G 15/0879* (2013.01); *G03G 2215/0129* (2013.01); *G03G 2215/0838* (2013.01)
USPC ..... 399/258

(58) Field of Classification Search
CPC ..... G03G 15/0865
USPC ..... 399/258, 260, 263
See application file for complete search history.

(56) References Cited

U.S. PATENT DOCUMENTS 8,295,739 B2 * 10/2012 Matsue et al. ..... 399/260
2012/0189351 A1 * 7/2012 Hayashi ..... 399/258

FOREIGN PATENT DOCUMENTS

JP 2-197873 A 8/1990
JP 2008-216360 A 9/2008

* cited by examiner

*Primary Examiner* — Susan Lee
(74) *Attorney, Agent, or Firm* — Sughrue Mion, PLLC

(57) ABSTRACT

A developer supplying device includes an inflow path; a guide path having an inlet to which a lower end of the inflow path is connected, the guide path extending diagonally downward from the inlet, the guide path guiding the developer to a developing unit; and a transport unit disposed in the guide path, the transport unit including a helical screw blade and a holder that holds the helical screw blade, the transport unit transporting the developer to the developing unit by rotating. In at least a part of a region in the guide path facing the inlet, a pitch of the helical screw blade in a horizontal direction is greater than or equal to a width of the inlet, and the holder is located at a position displaced from the rotation axis of the transport unit.

8 Claims, 9 Drawing Sheets

DEVELOPER SUPPLYING DEVICE AND IMAGE FORMING APPARATUS

CROSS-REFERENCE TO RELATED APPLICATIONS

This application is based on and claims priority under 35 USC 119 from Japanese Patent Application No. 2012-261695 filed Nov. 29, 2012.

BACKGROUND (i) Technical Field

The present invention relates to a developer supplying device and an image forming apparatus.

(ii) Related Art

Some image forming apparatuses, such as copiers, printers, facsimiles, and multifunctional machines, form an image by using an electrophotographic system.

With such electrophotographic image forming apparatuses, a surface of a photoconductor drum, which is an example of an image carrier, is exposed to light so as to form an electrostatic latent image on the surface. Then, a developing device (developing unit) forms a toner image by applying toner, which is an example of a developer, to the electrostatic latent image. Subsequently, the toner image on the surface of the photoconductor drum is transferred to a sheet, which is an example of a recording medium. Further, the sheet is transported to a fixing unit, which fixes the toner image onto the sheet.

As the demand for forming a high quality image has been increasing in recent years, the diameter of toner particles has been decreasing. When toner particles have a small diameter, it is more likely that the toner particles will aggregate and the aggregate of toner particles will not crumble.

Therefore, in a case where toner contained a container unit, such as a container or a toner cartridge, is supplied to a developing device through a developer supplying device, it is necessary to prevent aggregation of toner particles in the developer supplying device.

SUMMARY

According to an aspect of the invention, a developer supplying device includes an inflow path into which a developer falls from a container unit; a guide path having an inlet to which a lower end of the inflow path is connected, the guide path extending diagonally downward from the inlet, the guide path guiding the developer, which has been introduced into the guide path through the inlet from the inflow path, to a developing unit; and a transport unit disposed in the guide path, the transport unit including a helical screw blade and a holder that holds the helical screw blade, the transport unit transporting the developer, which has been introduced into the guide path, to the developing unit by rotating. In at least a part of a region in the guide path facing the inlet, a pitch of the helical screw blade in a horizontal direction is greater than or equal to a width of the inlet, and the holder is located at a position displaced from the rotation axis of the transport unit.

BRIEF DESCRIPTION OF THE DRAWINGS

Exemplary embodiments of the present invention will be described in detail based on the following figures, wherein.

DETAILED DESCRIPTION

Figure 1:
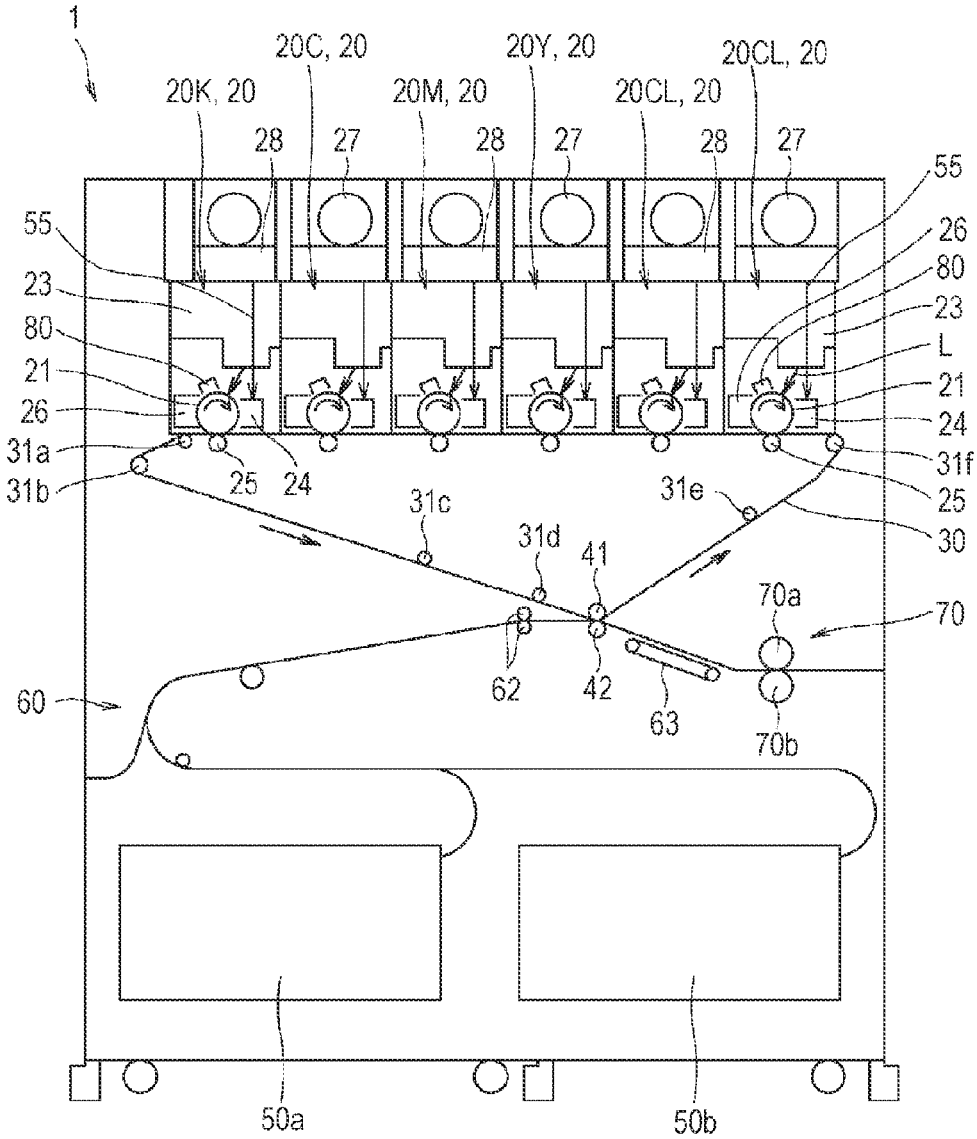
FIG. 1 is a schematic view of an image forming apparatus including a toner dispenser, which is an example of a developer supplying device according to an exemplary embodiment of the present invention.

Hereinafter, exemplary embodiments of the present invention will be described in detail with reference to the drawings. In the drawings of the exemplary embodiments, the same elements will be denoted by the same numerals and redundant description of such elements will be omitted.

FIG. 1 is a schematic view of an image forming apparatus 1 according to an exemplary embodiment of the present invention.

The image forming apparatus 1 is, for example, a tandem-type color printer. The image forming apparatus 1 includes plural image forming units 20, an intermediate transfer belt 30, a pair of a backup roller 41 and a second-transfer roller 42, sheet feed trays 50*a* and 50*b*, a sheet transport system 60, and a fixing unit 70.

The image forming units 20 include, for example, four color image forming units 20Y, 20M, 20C, and 20K for forming yellow, magenta, cyan, and black toner images and two image forming units 20CL for forming, for example, transparent toner images. The image forming units 20 form toner images in accordance with image information for respective colors, and then first-transfer the toner images to the intermediate transfer belt 30.

The six image forming units 20CL, 20CL, 20Y, 20M, 20C, and 20K are arranged in this order in a direction in which the intermediate transfer belt 30 rotates. Alternatively, instead of the image forming units for forming transparent toner images, image forming units for forming light color toner images, such as those of light yellow, light magenta, light cyan, and light black, may be used. Further alternatively, an image forming unit 20CL for a transparent color and an image forming unit for a light color may be disposed adjacent to each other.

Each of the image forming units 20 includes a photoconductor drum 21 (which is an example of an image carrier), a charger 80, an exposure device 23, a developing device 24, a first-transfer roller 25, and a drum cleaner 26. The charger 80 charges a surface of the photoconductor drum 21 to a predetermined potential. The exposure device 23 irradiates the charged surface of the photoconductor drum 21 with a laser beam L to form an electrostatic latent image. The developing device 24 forms a toner image by developing the electrostatic latent image formed on the photoconductor drum 21 by the exposure device 23. The first-transfer roller 25 transfers the toner image on the photoconductor drum 21 to the intermediate transfer belt 30 in a first-transfer region. The drum cleaner 26 removes remaining toner and paper dust from the surface of the photoconductor drum 21 after the toner image has been transferred.

A toner cartridge 27 is disposed above each of the image forming units 20. The toner cartridge 27 supplies toner (which is an example of a developer) to the image forming apparatus 1. A container 28 (which is an example of a container unit for containing a developer) is disposed below each of the toner cartridges 27. Toner in the toner cartridge 27 is supplied to the container 28, and the toner in the container 28 is supplied to the developing device 24 in accordance with the amount of toner consumed by the developing device 24.

The toner in the toner cartridge 27 is supplied to the developing device 24 via the container 28 so that an image forming operation may be continued when toner in the toner cartridge 27 has been depleted. That is, the toner cartridge 27 is replaced with a new toner cartridge while the image forming operation is being continued by using toner in the container 28.

A toner dispenser 55 (which is an example of a developer supplying device) is disposed so as to connect the container 28 to the developing device 24. The toner dispenser 55 supplies toner in the container 28 to the developing device 24. The container 28 and the toner dispenser 55 will be described below in detail.

The first-transfer roller 25 and the photoconductor drum 21 of each of the image forming units 20 are disposed with the intermediate transfer belt 30 therebetween. When a transfer bias voltage having a polarity opposite to that of charges on the toner is applied to the first-transfer roller 25, an electric field is generated between the photoconductor drum 21 and the first-transfer roller 25. Then, a charged toner image on the photoconductor drum 21 is transferred to the intermediate transfer belt 30 due to a Coulomb force. During a first-transfer operation, the photoconductor drum 21 rotates clockwise.

Color toner images formed by the image forming units 20 are successively transferred (first-transferred) to the intermediate transfer belt 30. The intermediate transfer belt 30 is an endless belt that is looped over plural support rollers 31*a* to 31*f* and the backup roller 41. The color toner images are first-transferred from the image forming units 20CL, 20Y, 20M, 20C, and 20K to the intermediate transfer belt 30 while the intermediate transfer belt 30 rotates counterclockwise.

The pair of the backup roller 41 and the second-transfer roller 42, which are disposed so as to face each other with the intermediate transfer belt 30 therebetween, performs a function of forming a full-color image by simultaneously transferring (second-transferring) the toner images, which have been overlappingly transferred to the intermediate transfer belt 30, to a sheet (which is an example of a recording medium). A region in which the backup roller 41 and the second-transfer roller 42 face each other is a second-transfer region.

The backup roller 41 is rotatably disposed on the back side of the intermediate transfer belt 30. The second-transfer roller 42 is rotatably disposed so as to face a surface of the intermediate transfer belt 30 to which toner images are transferred. The backup roller 41 and the second-transfer roller 42 are disposed so that their rotation axes extend parallel to each other (in a direction perpendicular to the plane of FIG. 1).

In order to transfer toner images from the intermediate transfer belt 30 to a sheet, a voltage having a polarity the same as that of charges on the toner is applied to the backup roller 41 or a voltage having a polarity opposite to that of charges on the toner is applied to the second-transfer roller 42. Thus, a transfer electric field is formed between the backup roller 41 and the second-transfer roller 42, and unfixed toner images carried on the intermediate transfer belt 30 are transferred to the sheet.

The sheet feed trays 50*a* and 50*b* each contain sheets having various sizes and thicknesses. A pick-up roller (not shown) of the sheet transport system 60 picks up a sheet from one of the sheet feed trays 50*a* and 50*b*. Then, a registration roller 62 of the sheet transport system 60 transports the sheet to the second-transfer region where toner images are transferred to the sheet. Subsequently, transfer belts 63 and 64 of the sheet transport system 60 transport the sheet to the fixing unit 70.

The fixing unit 70 fixes the unfixed toner images, which have been transferred to the sheet in the second-transfer region, onto the sheet by heating and pressing the sheet. The fixing unit 70 includes a heating roller 70*a* and a pressing roller 70*b* disposed so as to face the heating roller 70*a*.

After the second-transfer operation has been finished, the sheet is transported to a fixing nip between the heating roller 70*a* and the pressing roller 70*b* and is discharged while being nipped between the heating roller 70*a* and the pressing roller 70*b*. At this time, the sheet is heated by the heating roller 70*a* and is pressed by the pressing roller 70*b*, so that the toner images are fixed onto the sheet. After passing through the fixing unit 70, the sheet is transported to the discharge roller (not shown) and is discharged to the outside of the image forming apparatus 1.

Figure 2:
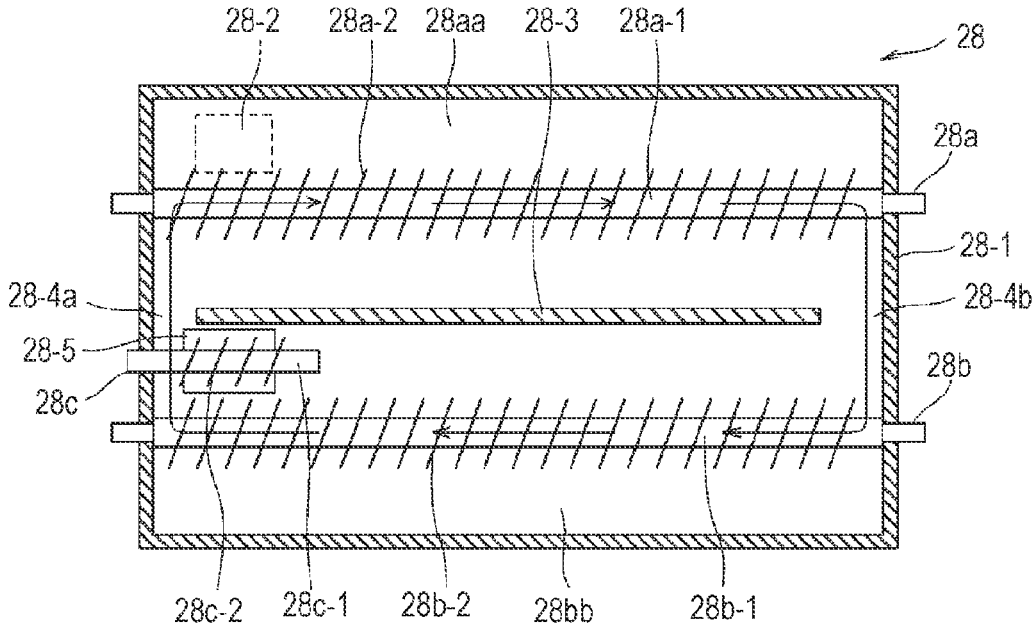
FIG. 2 is a top view illustrating the inside of a container included in the image forming apparatus of FIG. 1, which is an example of a container unit according to the exemplary embodiment of the present invention.

Next, referring to FIG. 2, the container 28 and the toner dispenser 55 will be described. FIG. 2 is a top view illustrating the inside of the container 28 included in the image forming apparatus 1.

As illustrated in FIG. 2, the container 28 includes a first agitation-transport member 28*a* and a second agitation-transport member 28*b*. The agitation-transport members 28*a* and 28*b* respectively include the rotary shafts 28*a*-1 and 28*b*-1, which are rotatably supported by a peripheral wall of the housing 28-1. Helical screw blades 28*a*-2 and 28*b*-2 are helically wound around the first and second agitation-transport members 28*a* and 28*b*, respectively.

A partition wall 28-3 is disposed between the first agitation-transport member 28*a* and the second agitation-transport member 28*b*. The partition wall 28-3 divides the inside of the container 28 into a first agitation-transport path 28*aa*, in which the first agitation-transport member 28*a* is disposed, and a second agitation-transport path 28*bb*, in which the second agitation-transport member 28*b* is disposed.

Connection holes 28-4*a* and 28-4*b* are formed in end portions of the partition wall 28-3 in the longitudinal direction.

The first agitation-transport path 28*aa* and the second agitation-transport path 28*bb* are connected to each other through the connection holes 28-4*a* and 28-4*b*.

An intake port 28-2 is formed in an upper surface of the housing 28-1 at an end of the first agitation-transport path 28*aa*. Toner is fed from the toner cartridge 27 and supplied into the container 28 through the intake port 28-2.

A discharge port 28-5 is formed in a bottom surface of the housing 28-1 at an end of the second agitation-transport path 28*bb*. Toner in the container 28 is discharged to the toner dispenser 55 through the discharge port 28-5. A discharge member 28*c*, which includes a rotary shaft 28*c*-1 and a helical screw blade 28*c*-2 helically wound around the rotary shaft 28*c*-1, is rotatably supported by the peripheral wall of the housing 28-1 and disposed above the discharge port 28-5.

Therefore, as the first and second agitation-transport members 28*a* and 28*b* rotate, toner in the container 28 is agitated and transported in the first agitation-transport path 28*aa* and the second agitation-transport path 28*bb* and circulates between the first agitation-transport path 28*aa* and the second agitation-transport path 28*bb*.

Moreover, as the discharge member 28*c* rotates, the toner in the container 28 falls by gravity through the discharge port 28-5 and is discharged to the toner dispenser 55.

Figure 3:
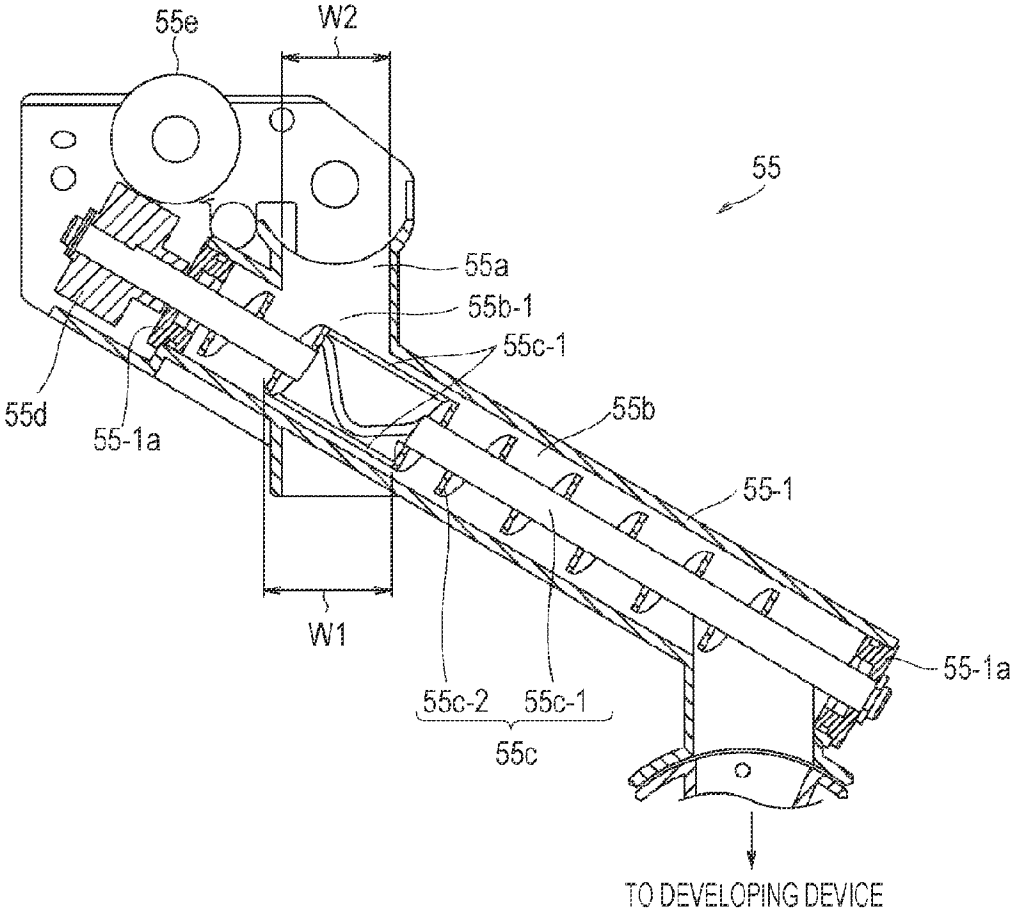
FIG. 3 is a side sectional view of the toner dispenser included in the image forming apparatus FIG. 1, which is an example of an developer supplying device according to the exemplary embodiment of the present invention.

As illustrated in FIG. 3, the toner dispenser 55, to which toner is supplied from the container 28, includes a housing 55-1, through which the container 28 is connected to the developing device 24. A hollow inflow path 55*a* and a hollow guide path 55*b* are formed in the housing 55-1.

The inflow path 55*a* extends vertically so that the toner, which has been fed from the container 28 due to the rotation of the discharge member 28*c* of the container 28, may fall into the inflow path 55*a* by gravity.

An inlet 55*b*-1 is formed in the guide path 55*b*, and a lower end of the inflow path 55*a* is connected to the inlet 55*b*-1. The guide path 55*b* extends diagonally downward from the inlet 55*b*-1 and guides the toner, which has been introduced into the guide path 55*b* from the inflow path 55*a* through the inlet 55*b*-1, to the developing device 24.

A transport member 55*c* (which is an example of a transport unit) is disposed in the guide path 55*b* so as to extend along the guide path 55*b*. The transport member 55*c* rotates and transports the toner, which has introduced into the guide path 55*b*, to the developing device 24.

As illustrated in FIG. 3, the transport member 55*c* includes a holder 55*c*-1, which extends along the guide path 55*b*. Ends of the holder 55*c*-1 are rotatably supported by bearings 55-1*a*, which are fitted into the housing 55-1. A helical screw blade 55*c*-2 is helically wound around the holder 55*c*-1. Therefore, when the transport member 55*c* rotates, toner that has been introduced into the guide path 55*b*, which is inclined, is transported by the helical screw blade 55*c*-2 to the developing device 24.

An upper end portion of the holder 55*c*-1 protrudes from the bearing 55-1*a*. A driven gear 55*d* is attached to the upper end portion. The driven gear 55*d* meshes with a drive gear 55*e*, which is attached to a rotary drive shaft (not shown), which extends from the body of the image forming apparatus 1. Therefore, the drive gear 55*e* transmits a driving force to the driven gear 55*d*, thereby rotating the holder 55*c*-1, that is, the transport member 55*c*. Then, as described above, toner in the guide path 55*b* is transported to the developing device 24 by the helical screw blade 55*c*-2.

Figure 4:
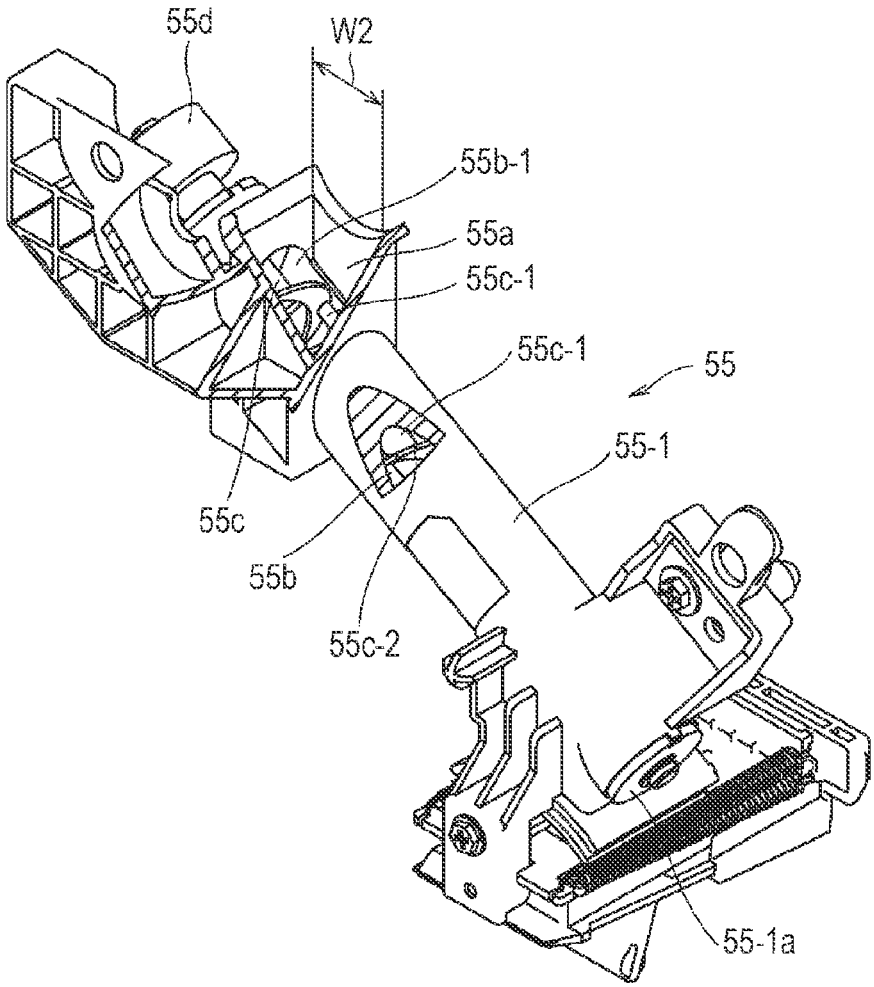
FIG. 4 is partially cut-away perspective view of the toner dispenser of FIG. 3.
Figure 5:
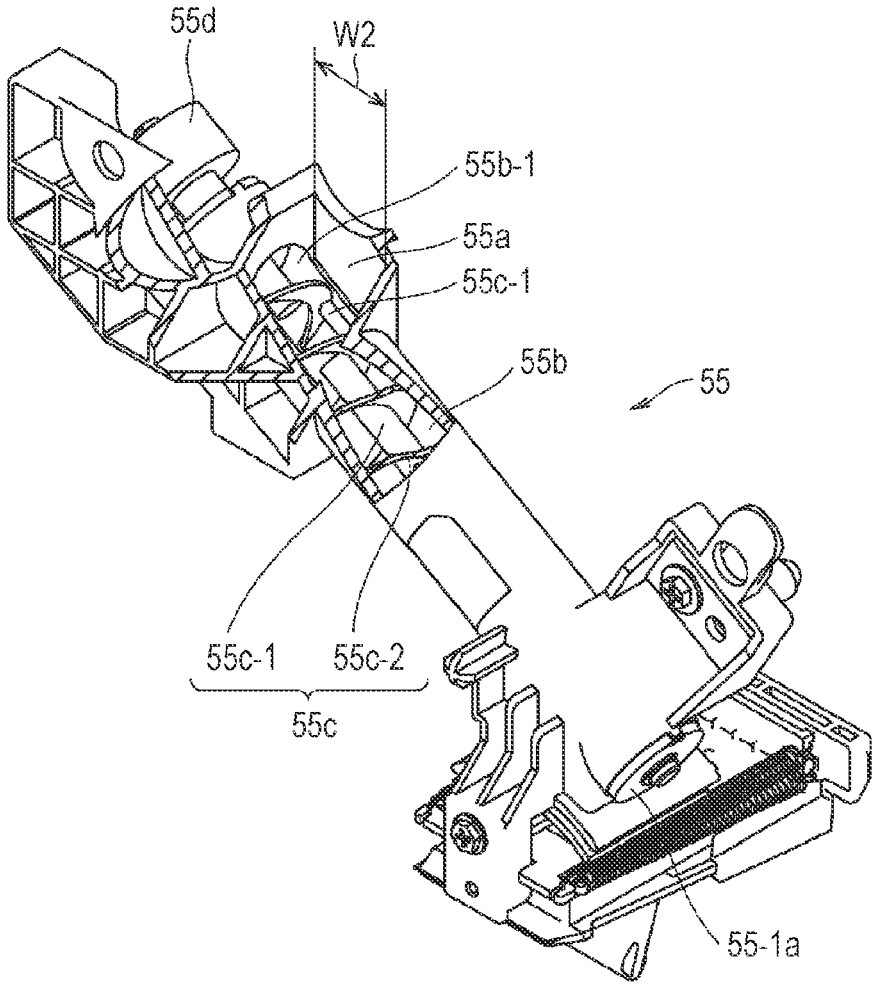
FIG. 5 is partially cut-away perspective view of the toner dispenser of FIG. 3, showing a cut-away region larger than that of FIG. 4.

As illustrated in FIGS. 3, 4, and 5, in a part of a region in the guide path 55*b* facing the inlet 55*b*-1, a pitch W1 of the helical screw blade 55*c*-2 in the horizontal direction is greater than or equal to a width W2 of the inlet 55*b*-1 (in the horizontal direction). In the region facing the inlet 55*b*-1, the holder 55*c*-1 is displaced from the rotation axis of the transport member 55*c*, although the holder 55*c*-1 is disposed along the rotation axis of the transport member 55*c* outside the region facing the inlet 55*b*-1.

In the present exemplary embodiment, in a part of a region in the guide path 55*b* facing the inlet 55*b*-1, the pitch W1 of the helical screw blade 55*c*-2 in the horizontal direction is greater than or equal to the width W2 of the inlet 55*b*-1, through which toner falls by gravity. Alternatively, the pitch W1 may be greater than or equal to the width W2 in the entirety of the region facing the inlet 55*b*-1.

Figure 6:
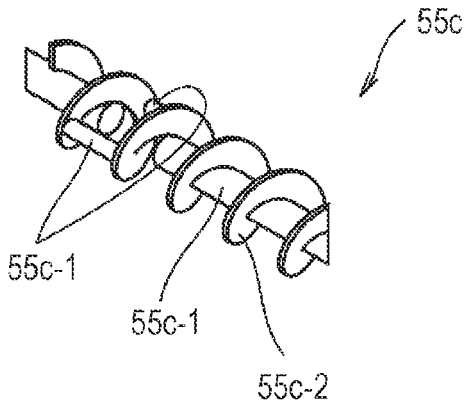
FIG. 6 is a perspective view of a transport member, which is an example of a transport unit, of the toner dispenser of FIG. 3, illustrating the shape of a portion of the transport member facing an inlet.
Figure 7:
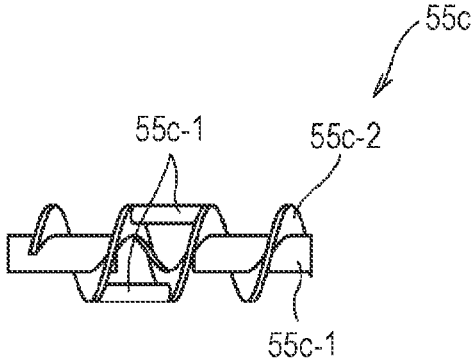
FIG. 7 is a front view of the transport member of FIG. 6.

To be specific, as illustrated in FIGS. 6 and 7, in the region facing the inlet 55*b*-1, the holder 55*c*-1 is formed so as to connect a pair of adjacent portions of the helical screw blade 55*c*-2 that are separated from each other by a distance equal to the pitch W1 and is disposed at a position outward from the rotation axis of the transport member 55*c* in a radial direction of the helical screw blade 55*c*-2.

When the diameter of toner particles is reduced in order to increase the quality of an image, it is more likely that the toner particles will aggregate and the aggregate of toner particles will not crumble. Such an aggregate of toner particles falls into the inflow path 55*a* from the container 28 by gravity. The aggregate of toner particles does not crumble and becomes stuck on the holder 55*c*-1 in the region facing the inlet 55*b*-1 between the inflow path 55*a* and the guide path 55*b*. As a result, toner is not stably supplied to the developing device 24.

In the present exemplary embodiment, in the region facing the inlet 55*b*-1, the pitch W1 of the helical screw blade 55*c*-2 in the horizontal direction is greater than or equal to the width W2 of the inlet 55*b*-1, and the holder 55*c*-1 is displaced from the rotation axis of the transport member 55*c*. Therefore, in a part of the region facing the inlet 55*b*-1, the holder 55*c*-1 is not present at the rotation axis of the transport member 55*c*, and the holder 55*c*-1 performs a circular motion around the axis of the transport member 55*c*.

Therefore, when an aggregate of toner particles each having a small diameter is introduced into the guide path 55*b*, the aggregate of toner particles does not become stuck on the holder 55*c*-1 in the region facing the inlet 55*b*-1 but crumbles due to the circular motion of the holder 55*c*-1, and the toner particles are transported along the guide path 55*b* as the helical screw blade 55*c*-2 rotates.

Thus, toner contained in the container 28 is supplied to the developing device 24 without being aggregated.

As illustrated in FIG. 3, in the region facing the inlet 55*b*-1, the holder 55*c*-1 is formed so as to connect a pair of adjacent portions of the helical screw blade 55*c*-2 that are separated from each other by a distance equal to the pitch W1 and is disposed at a position outward from the rotation axis of the transport member 55*c* in a radial direction of the helical screw blade 55*c*-2. Therefore, in a part of the region facing the inlet 55*b*-1, the holder 55*c*-1 performs a circular motion having a diameter that is close to the inside diameter of the guide path 55*b*. Accordingly, when an aggregate of toner particles is introduced into the guide path 55*b* through the inlet 55*b*-1 and falls into the region facing the inlet 55*b*-1, which is a space in which the pitch W1 of the helical screw blade 55*c*-2 in the horizontal direction is greater than or equal to the width W2 of the inlet 55*b*-1, the toner particles do not become stuck in the region but are scraped off by the holder 55*c*-1, which performs a circular motion, and are transported along the guide path 55*b*.

The pair of portions of the holder 55*c*-1, which are disposed in the region facing the inlet 55*b*-1, each have a bar-like shape. Each of the portions of the holder 55*c*-1 disposed in the region facing the inlet 55*b*-1 has a diameter smaller than that of the holder 55*c*-1 in other region.

Therefore, the volume of the region facing the inlet 55*b*-1, which is a space in which the pitch W1 of the helical screw blade 55*c*-2 in the horizontal direction is greater than or equal to the width W2 of the inlet 55*b*-1, is larger than that in a case where the diameter of the holder 55*c*-1 is uniform in the entire region. Thus, a larger amount of toner falls into the space and is transported to the developing device 24.

Figure 8:
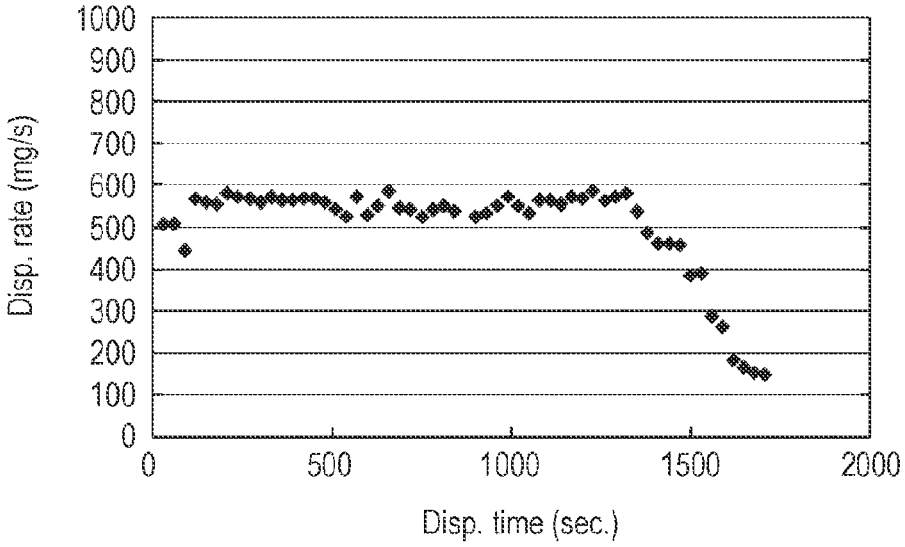
FIG. 8 is graph representing the toner transport rate of the toner dispenser according to the exemplary embodiment of the present invention.
Figure 9:
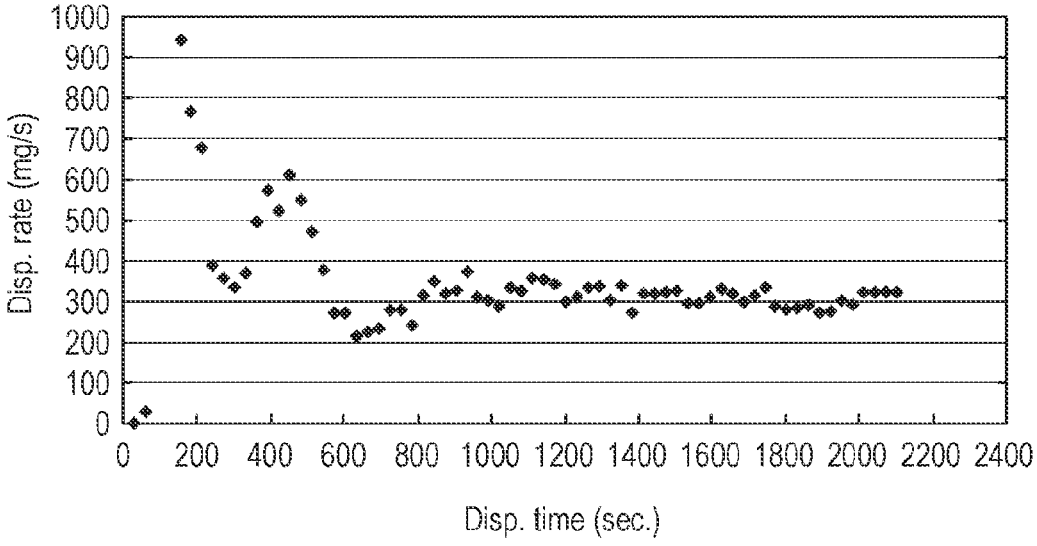
FIG. 9 is graph representing the toner transport rate of a toner dispenser according to a comparative example.

FIG. 8 illustrates the relationship between the toner transport time (Disp. time) and the toner transport rate (Disp. rate) of the toner dispenser 55 according to the present exemplary embodiment. FIG. 9 illustrates the relationship between the toner transport time (Disp. time) and the toner transport rate (Disp. rate) of a toner dispenser according to a comparative example, in which the holder is disposed at the rotation axis of the transport member in the region facing the inlet 55*b*-1.

As illustrated in FIG. 9, with the toner dispenser according to the comparative example, the toner transport rate is very high immediately after transportation of toner is started but sharply decreases subsequently. Thus, toner is not stably supplied.

In contrast, with the toner dispenser 55 according to the present exemplary embodiment, the toner transport rate does not differ significantly between the initial time immediately after transportation of toner is started and a time after a certain period from the initial time. Thus, toner is considerably stably supplied. The decrease in the toner transport rate after about 1,300 (sec.) from the initial time is due to decrease in the amount of toner in the container 28.

Figure 10:
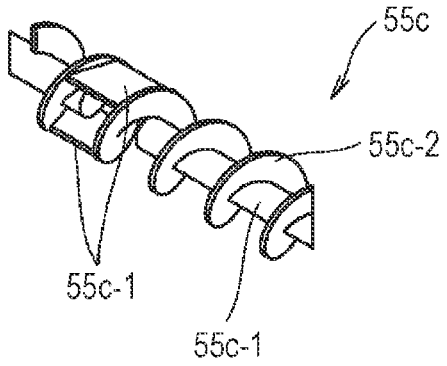
FIG. 10 is a perspective view of a transport member of a toner dispenser according to a modification of the exemplary embodiment of the present invention, illustrating the shape of a portion of the transport member facing an inlet.
Figure 11:
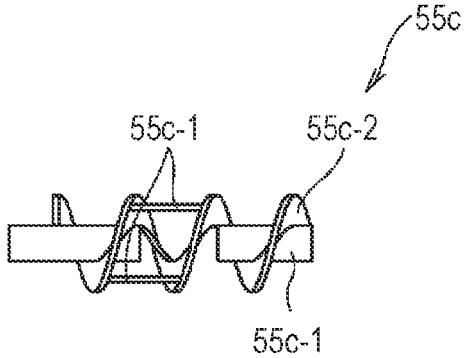
FIG. 11 is a front view of the transport member of FIG. 10.

In the exemplary embodiment described above, in the region facing the inlet 55*b*-1, the portions of the holder 55*c*-1 disposed at ends of the helical screw blade 55*c*-2 in the width direction each have a bar-like shape. Alternatively, as illustrated in FIGS. 10 and 11, the portions each may have a plate-like shape.

When the portions of the holder 55*c*-1 each have a plate-like shape, the rigidity of the holder 55*c*-1 in the region facing the inlet 55*b*-1 is higher than that in the case where the portions each have a bar-like shape. Moreover, as the transport member 55*c* rotates, the plate-like portions of the holder 55*c*-1 scrape off toner adhering to an inner wall of the guide path 55*b*, so that almost all toner in the guide path 55*b* is transported.

It is not necessary that the portion of the holder 55*c*-1 in the region facing the inlet 55*b*-1 be formed as illustrated in FIGS. 6, 7, 10, and 11. Alternatively, as illustrated in FIGS. 12 to 15, at least a part of the holder 55*c*-1 may include a U-shaped or V-shaped curved portion that is curved so as to be displaced from the rotation axis of the transport member 55*c*.

Figure 12:
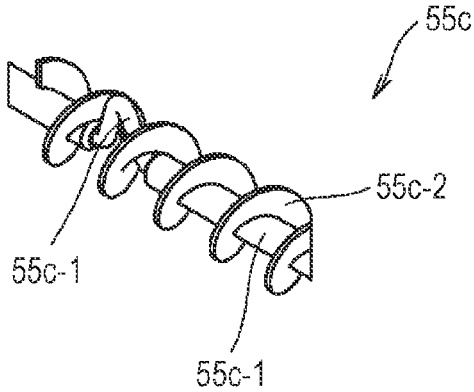
FIG. 12 is a perspective view of a transport member of a toner dispenser according to another modification of the exemplary embodiment of the present invention, illustrating the shape of a portion of the transport member facing an inlet.
Figure 13:
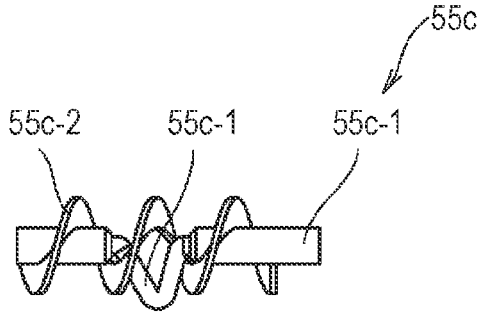
FIG. 13 is a front view of the transport member of FIG. 12.

That is, in the example illustrated in FIGS. 12 and 13, a portion of the holder 55*c*-1 disposed in the region facing the inlet 55*b*-1 is bent at an end of the helical screw blade 55*c*-2 in the width direction. In the example illustrated in FIGS. 14 and 15, a portion of the holder 55*c*-1 disposed in the region facing the inlet 55*b*-1 is curved at an end of the helical screw blade 55*c*-2 in the width direction.

With such structures, because the holder 55*c*-1 is curved in the region facing the inlet 55*b*-1, when an aggregate of toner particles falls onto the holder 55*c*-1, the aggregate of toner particles crumbles due to the rotation of the transport member 55*c*.

When a portion of the holder 55*c*-1 disposed in the region facing the inlet 55*b*-1 is bent at an end of the helical screw blade 55*c*-2 in the width direction as illustrated in FIGS. 12 and 13, it is more likely that toner will be introduced into a space where the pitch W1 of the helical screw blade 55*c*-2 in the horizontal direction is greater than or equal to the width W2 of the inlet 55*b*-1.

Figure 14:
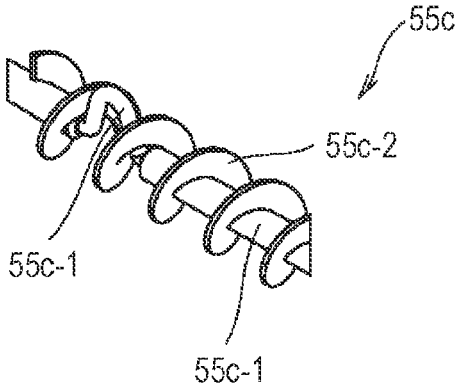
FIG. 14 is a perspective view of a transport member of a toner dispenser according to still another modification of the exemplary embodiment of the present invention, illustrating the shape of a portion of the transport member facing an inlet.
Figure 15:
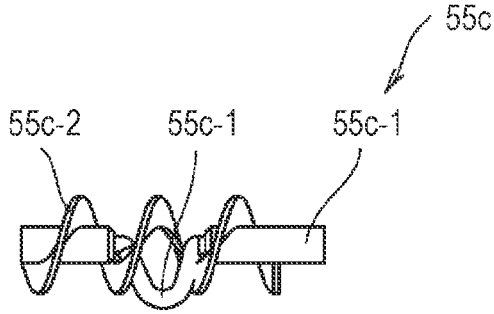
FIG. 15 is a front view of the transport member of FIG. 14.

When a portion of the holder 55*c*-1 disposed in the region facing the inlet 55*b*-1 is curved at an end of the helical screw blade 55*c*-2 in the width direction as illustrated in FIGS. 14 and 15, the volume of the region facing the inlet 55*b*-1, which is a space in which the pitch W1 of the helical screw blade 55*c*-2 in the horizontal direction is greater than or equal to the width W2 of the inlet 55*b*-1, is larger than that in a case where the holder 55*c*-1 is curved at a position located inward from the end of the helical screw blade 55*c*-2 in the width direction. As a result, a larger amount of toner falls into the space and is transported to the developing device 24.

In the foregoing description, toner, which is an example of a developer, is contained in the container 28, which is an example of a container unit for containing a developer, and the toner dispenser 55, which is an example of a developer supplying device, supplies the toner to the developing device 24. Alternatively, the toner cartridge 27 may also serve as the container, and toner in the toner cartridge 27 may be directly supplied through the toner dispenser 55 to the developing device 24.

In the foregoing description, the present invention is applied to an image forming apparatus in which toner images formed on an intermediate transfer belt are simultaneously transferred to a recording medium. However, the present invention may be used for any image forming apparatus that forms an image by using a developer such as toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer supplying device comprising:

an inflow path into which a developer falls from a container unit;

a guide path having an inlet to which a lower end of the inflow path is connected, the guide path extending diagonally downward from the inlet, the guide path guiding the developer, which has been introduced into the guide path through the inlet from the inflow path, to a developing unit; and a transport unit disposed in the guide path, the transport unit including a helical screw blade and a holder that holds the helical screw blade, the transport unit transporting the developer, which has been introduced into the guide path, to the developing unit by rotating, wherein, in at least a part of a region in the guide path facing the inlet, a pitch of the helical screw blade in a horizontal direction is greater than or equal to a width of the inlet, and the holder is located at a position displaced from the rotation axis of the transport unit.

2. The developer supplying device according to claim 1, wherein, in at least a part of the region facing the inlet, the holder is formed so as to connect a pair of adjacent portions of the helical screw blade that are separated from each other by a distance equal to the pitch and is disposed at a position outward from the rotation axis of the transport unit in a radial direction of the helical screw blade.

3. The developer supplying device according to claim 2, wherein each of the portions of the holder disposed in the region facing the inlet has a bar-like shape and has a diameter smaller than a diameter of the holder in other region.

4. The developer supplying device according to claim 2, wherein each of the portions of the holder disposed in the region facing the inlet has a plate-like shape.

5. The developer supplying device according to claim 1, wherein, in at least a part of the region facing the inlet, at least a part of the holder includes a U-shaped or V-shaped curved portion that is curved so as to be displaced from the rotation axis of the transport unit.

6. The developer supplying device according to claim 5, wherein a portion of the holder disposed in the region facing the inlet is bent at an end of the helical screw blade in a width direction.

7. The developer supplying device according to claim 5, wherein a portion of the holder disposed in the region facing the inlet is curved at an end of the helical screw blade in a width direction.

8. An image forming apparatus comprising:

an image carrier on which an electrostatic latent image is formed;

a developing device disposed so as to face the image carrier, the developing device developing the electrostatic latent image to form a visible image by applying the developer to the electrostatic latent image on the image carrier;

the developer supplying device according to claim 1, the developer supplying device supplying the developer in the container unit to the developing device; and a transfer unit disposed so as to face the image carrier, the transfer unit transferring the visible image formed on the image carrier to a transfer medium.

* * * * *